US005193673A

United States Patent [19]

Rathbone et al.

[11] Patent Number: 5,193,673

[45] Date of Patent: Mar. 16, 1993

[54] ENVIRONMENTALLY SAFE HOLDER DEVICE

[76] Inventors: Thomas Rathbone, 2695 Cottontail La., Loosos, Calif. 93402; Timothy J. Martin, 1888 S. Arbutus, Lakewood, Colo. 80228

[21] Appl. No.: 684,232

[22] Filed: Apr. 12, 1991

[51] Int. Cl.[5] ..... B65D 75/00; B65D 65/00

[52] U.S. Cl. ..... 206/150; 229/237; 206/428

[58] Field of Search ..... 206/150, 158, 161, 199, 206/428; 229/924, 237; 383/207, 208

[56] References Cited

U.S. PATENT DOCUMENTS

| | | | |
|---|---|---|---|
| 2,997,169 | 8/1961 | Poupitch | 206/150 |
| 3,038,602 | 6/1962 | Rapata | 206/150 |
| 3,504,790 | 4/1970 | Owen | 206/162 |
| 3,721,337 | 3/1973 | Braun et al. | 206/150 |
| 4,064,989 | 12/1977 | Olsen | 206/428 |
| 4,925,020 | 5/1990 | Gordon | 206/150 |
| 5,016,750 | 5/1991 | Gordon | 206/150 |
| 5,020,661 | 6/1991 | Marco | 206/150 |
| 5,072,829 | 12/1991 | Marco et al. | 206/150 X |

*Primary Examiner*—Paul T. Sewell
*Assistant Examiner*—Beth Anne Cicconi

[57] ABSTRACT

A container holder adapted to releaseably retain a plurality of similarly configured containers and adapted to permit release of each container individually.

The holder is comprised of a central panel portion and a plurality of retaining portions. Each of the retaining portions has a pull tab that corresponds to it. The pull tab is joined to its respective retaining portion along the margin. The pull tab has a scoreline of a selected length proximate the pull tab so that the pull tab can be operated to release the loop-like structure thus preventing wildlife from becoming entangled in unruptured rings of plastic containers once the package is discarded.

18 Claims, 3 Drawing Sheets

ENVIRONMENTALLY SAFE HOLDER DEVICE

FIELD OF THE INVENTION

The present invention generally relates to environmentally friendly packaging. More specifically the present invention concerns holders adapted to receive and releasably retain a plurality of geometrical objects. Specifically, the invention is directed to plastic holder for cans such as soda pop and beer containers.

BACKGROUND OF THE INVENTION

Many developed countries unfortunately develop a tendency to rely on disposable items. Such societies use disposable diapers, disposable utensils, disposable paper towels, disposable packaging, disposable pop cans and numerous other items that are routinely discarded after use. As this technology grows and items are made more disposable, and more inexpensive to produce, the technology for minimizing the effects on the environment often lags behind. One specific example of lagging technology includes non-biodegradable disposable diapers, which remain in landfills for an inordinant amount of time.

Another example of a disposable item which has a negative effect on the environment and is of specific concern to the present invention is the plastic holder for carrying and transporting a plurality of objects, specifically beverage cans. It has been found that the plastic holders which are shaped with loops designed to enclose pop cans or the alcohol containers often are inappropriately discarded. These holders can end up in places where wildlife, for example, fowl, fish and water rodents are located. When in the water or on the land ducks, geese and other birds can often get caught in these rings. Once caught, a duck is unable to fly or swim as nature had intended it to. The holder's rings become entangled in the wings, break off feathers, become ensnared around their necks and cause them to drown when they submerge looking for food. Likewise, fish and water animals can be trapped in the remaining rings and are often unable to disengage from the beverage holder. The result of being ensnared in a holder ring is often death.

The manufacturers of the various beverage holders have not adequately taken into consideration the fact that humans are known to discard disposable items in inappropriate areas. There is a need for a disposable beverage holder which can be employed to transport a six-pack or a twelve-pack of soft drinks, beer and the like as one single unit, and yet, if inappropriately disposed of will not have a harmful effect on the environment. The present invention addresses this need for an environmentally safe holder for plurality of objects such as pop cans, juice cans, beer cans, etc. The present invention allows the cans to be transported as a single unit and will not, if properly used, lessen the chance of harm to wildlife.

SUMMARY OF THE INVENTION

Accordingly, the object of the present invention to provide a new and useful holder adapted to permit a plurality of objects to be transported as a single unit which, when properly used, will lessen the risk of harm to fowl and other wildlife even if the holder is improperly discarded or otherwise enters the ecosystem.

It is also the object of the present invention to provide a relatively cheap and inexpensive, wildlife safe method for transporting the plurality of objects as a single unit.

It is further an object of the present invention to provide a holder for a plurality of objects which is adapted to have closed, loop-like structures when being used as a holder and have severed loop-like structures when the holder is empty and is ready for disposal.

Accordingly, the broad form of the present invention provides a holder adapted to retain a plurality of objects. These objects can be of a variety of geometric shapes such as circular, square, or triangular. The holder is adapted to permit the release of each of the objects individually while allowing the objects to be transported as a unit. This holder is comprised of a plurality of retaining portions joined with a central panel portion. The retaining portions each define an opening sized to receive a respective one of the objects and having an outer peripheral edge portion. The outer peripheral edge portion has a peripheral margin that is located between the opening and the peripheral portion to define a loop-shaped structure that acts to retain objects received therein. The holder also has a pull-tab structure joined to each of the retaining portions along the respective margin. The margin has a score line that extends at least partially across and is located approximate to the respective pull-tab. The retaining portion may be parted by manually pulling the respective pull-tab, thereby releasing the object and destroying the integrity of the loop-shaped structure by severing the retaining loop.

As previously mentioned prior to this time, industry has produced a holder adapted to releasably retain a plurality of cylindrical cans as a packaged unit that has a potential for harming wildlife. The holder is formed as a planer web having a peripheral edge and a thickness between an upper surface and a lower surface. The holder has a plurality of circular openings formed therethrough to form a plurality of loop-shaped structures each operative to receive and retain a respective cylindrical can.

The present invention has an improvement that lessens the potential for harming wildlife. This improvement comprises a pull-tab associated with each of the openings and a score line associated with each pull-tab. Each score line has a depth extending through the thickness of the web and extending at least partially across a margin portion of the web. The margin portion being between a respective opening and the peripheral edge and located proximate the associated pull-tab. Each of the pull-tabs may be manually grasped and operated to sever the respective margin which releases the can received in the opening and breaks the loop-shaped structure. The release of the can and the breaking of the respective loop-shaped structure decreases the potential danger the holder may have to wildlife and fowl when discarded.

The holder's planar web has a central panel portion. This central panel portion can include a carrying means that is adapted for allowing manual transportation of the cylindrical cans or plurality of objects as a single unit. This carrying means can be formed by a plurality of holes sized and configured to be grasped by the person's hands and fingers or alternatively, the carrying means can include a handle portion. The central portion has transverse and longitudinal axes which intersect at mid-point, the retaining portions are usually arranged to be symmetrical about both of the transverse and longitudinal axes.

The pull-tab structure which can be integrally formed with the retaining portion can be a variety of shapes including a lobe. The lobe can have a port sized to receive a human finger whereby the pull-tab structure is readily grasped and operated.

In the preferred embodiment of the present invention as noted above, the pull-tab structure is formed as a lobe having a port. The pull-tab structure projects inwardly into the opening of the respective retaining portion such that when one of said cylindrical objects is received in respective opening the pull-tab is deflected away from the opening. Thus, the pull-tab which is projecting from the margin radially inwardly of its respective opening has a first position when there is no can in the respective opening and has a second a position when the can is received in the respective opening. When in the second position, the pull-tab radially projects upwardly for the retaining portion. The retaining portion has an upper and lower surface which defines a thickness of the retaining portion therebetween. The upward projection of the pull-tab substantially perpendicular to the upper surface positions the pull-tab such that it can be readily accessible to be manually pulled to part the retaining portion.

Turning specifically to the score line of the present invention, it can have a depth that extends into the retaining portion at least 50% of the thickness or alternatively, the score line can have a variable depth across the width of the margin, in such a manner that the score line lies deeper at a location proximate its associated pull-tab. The score line facilitates the severing of the loop-shaped structure when an object is to be removed from the holder.

In an alternative embodiment of the present invention, the pull-tab structure can again be formed of a lobe having a port sized to receive a finger but instead of having a pull-tab that projects inwardly in this alternative embodiment the pull-tab projects outwardly of its respective retaining structure. This embodiment includes a pull-tab and the association score line that projects radially radially outwardly from its respective opening. A similar depth of the score line as previously mentioned in reference to the preferred embodiment can be employed by this alternative embodiment.

In another alternative embodiment of the present invention, the openings along the central portion are circular and the pull-tab and the score line project tangently therefrom.

These and other objects of the present invention will become more readily appreciated and understood from a consideration of the following detailed description of the preferred embodiment when taken together with the accompanying drawings, in which:

DETAILED DESCRIPTION OF THE DRAWINGS

DETAILED DESCRIPTION OF THE PREFERRED EMBODIMENT

The present invention generally relates to a environmentally safe packaging device, and specifically to holders adapted to releasably retain a plurality of cylindrical geometric objects such as beverage containers.

Figure 1:
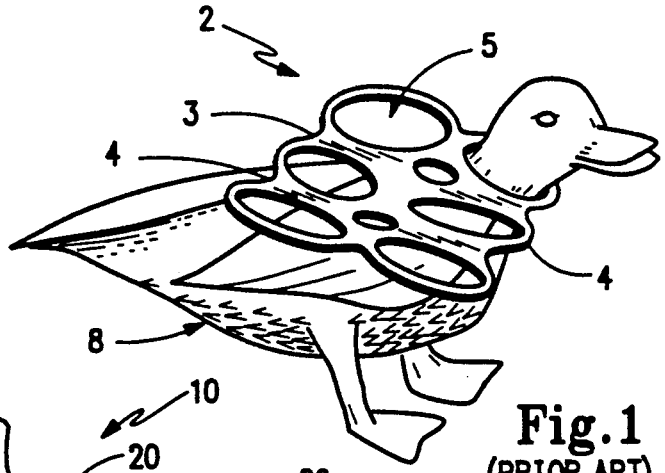
Fig.1 (PRIOR ART)
FIG. 1 shows a perspective view of the prior art plastic beverage holder ensnaring the head of a duck.

The prior art holder 2 shown in FIG. 1 is of well-known construction and widespread use to releasably retain a plurality of cylindrical cans as a packaged unit. This holder is formed as a planar web 3 having a peripheral edge 4 and a having an upper surface and a lower surface and a thickness therebetween. The web 3 of holder 2 has a plurality of circular openings 5 therethrough to form a plurality of closed loop-shaped structures each operative to receive and retain a respective cylindrical can. When this holder is devoid of cylindrical cans, a 2×3 matrix of closed loops remain. Thus, when improperly disposed of it is hazardous to the environment, specifically, to water fowl, fish and other small animals which can become fatally ensnared in the loops. Thus, for example, it may be seen that holder 2 may ensnare the neck of a duck 8.

Figure 2:
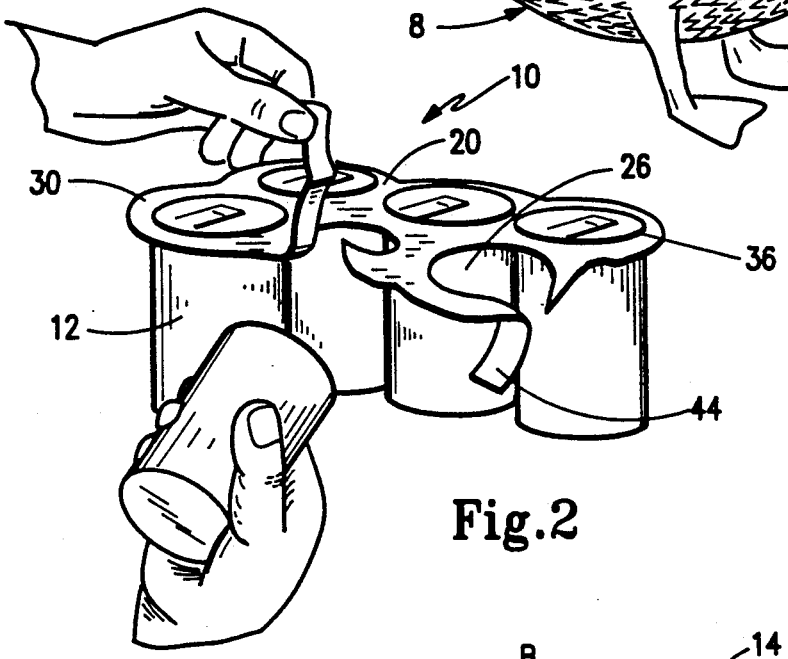
FIG. 2 shows a perspective view of the first exemplary embodiment of the present invention in use with beverage cans.

FIG. 2 shows the present invention which is made specifically to reduce the hazards to fowl, fish and water animals that the prior art presents. The present invention, like the prior art, comprises a holder having a web adapted to releasably retain a plurality of objects having a common geometric shape, for example, beverage cans. This holder is adapted to permit the transportation of the individual objects as a unit and to release each of the objects individually. An important feature of this invention, though, is the structure provided to sever or part the loop-shaped portions which otherwise tend to ensnare animals.

Turning to the specifics of the present invention as best shown in the exemplary embodiment of FIGS. 2–5, the holder 10 includes a web 14 having a central panel portion 20 joined to a plurality of retaining portions 30 organized in a selected array, such as the standard 2×3 matrix. The central portion 20 has a transverse axis A and a longitudinal axis B which intersect at mid-point C. The array of retaining portions 30 are preferably symmetrical about both of the transverse and longitudinal axes. Holder 10 has a plurality of openings 26, each of which is associated with a respective retaining portion and is preferably circular in shape and sized to receive the object 12, such as a beverage can.

Figure 3:
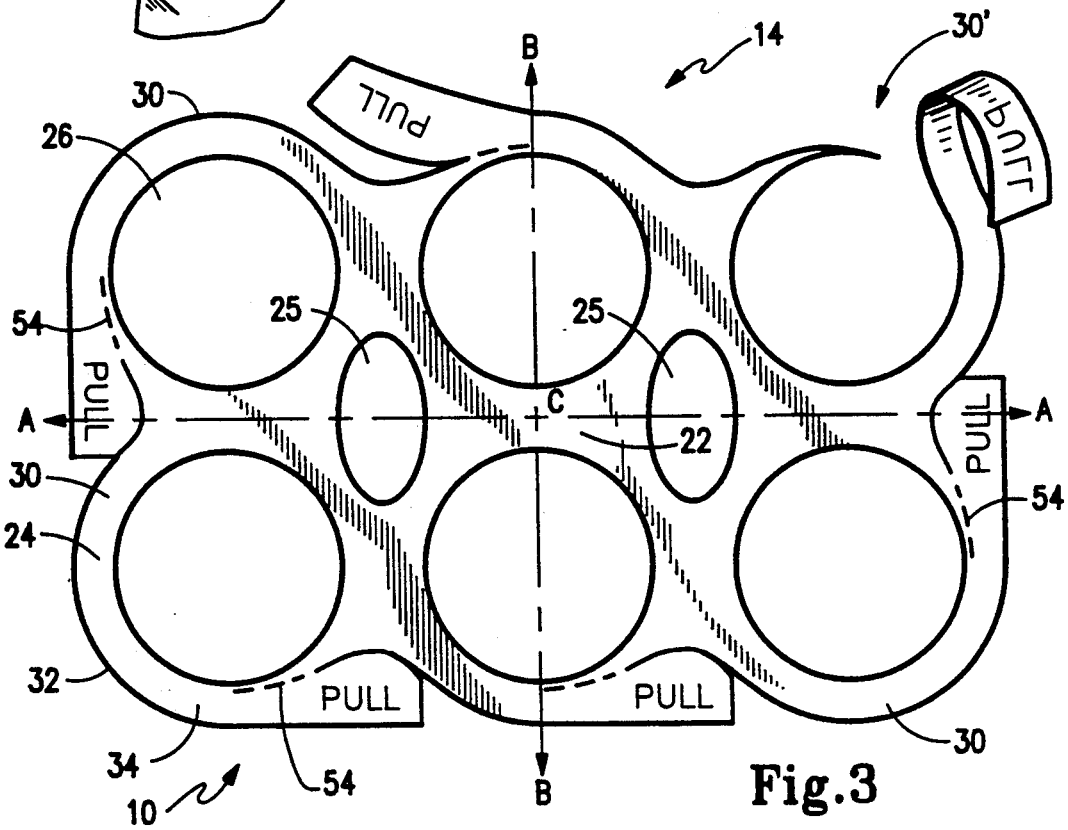
FIG. 3 shows a top plan view of the holder according to the first exemplary embodiment of the present invention.

As shown with greater detail in FIG. 3, each retaining portion 30 has an outer peripheral edge portion 32 with a peripheral margin 34 of a selected width located between the opening 26 and the peripheral edge portion 32. The retaining portion 30 thereby defines a loop-shaped structure. It can be readily seen that the loop-shaped retaining portion acts to retain the object 12.

Furthermore, as seen in both FIG. 2 and 3, each retaining portion 30 has a corresponding pull-tab structure 44 which is used to sever the loop-shaped structure and release an object 12. In FIG. 2, for example, one loop-shaped structure 30' has been severed to release the object. The pull-tabs 44 are sized to be grasped between the thumb and fingers of a hand and manipulated, as is shown in FIG. 2, to release the object 12 and completely sever the peripheral margin 34. Thus, the present invention reduces the danger to wildlife such as fowl, fish and water animals when the objects are removed and the retaining portions properly severed.

FIGS. 2 and 3 also show that the central panel portion 20 forms a carrying means which is adapted to allow manual transportation of the objects as a single unit. The carrying means shown in FIGS. 2 and 3 includes a plurality of holes 24 sized and configured to be grasped by a person's hand and fingers. Alternatively, the carrying means on the central portion 20 can include a handle portion.

FIG. 3 shows web 14, central portion 20, retaining portion 30 and pull-tab 44 in more detail. Here, each pull-tab 44 is formed integrally with its respective retaining portions 30 along the peripheral margin 34. To facilitate the severance of the associated loop-structure, i.e., each retaining portion 30, each pull-tab 44 as a score line 54 that extends at least partially across the width of the margin 34 for a selected length. Each score line 54 is located proximate its respective pull-tab 44.

Figure 4:
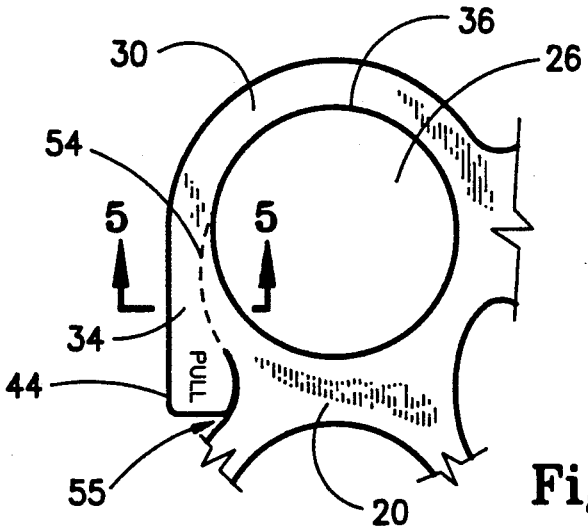
FIG. 4 shows an enlarged top plan view of a retaining ring structure of the holder of FIG. 3.
Figure 5:
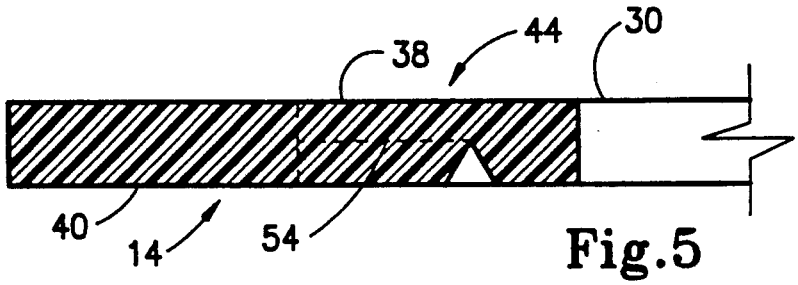
FIG. 5 shows a cross-sectional view taken about lines 5—5 of FIG. 4.

The pull-tab and score line of this first exemplary embodiment is most readily seen in FIG. 4. Here, it may be appreciated that each score line 54 projects tangentially from its associated opening 26 completely across the width of the margin 34 proximate to the pull-tab 44 and terminates at a notch or cut 55 that forms tab 44 out of web 14. The score line 54 provides a weakened line or area to facilitate the tearing of retaining portion 30 thereby severing the peripheral margin 34 and thus destroying the closedness of the loop-shaped structure. In FIG. 5, score line 54 is shown to be formed partially through the thickness of web 14 between upper surface 38 and lower surface 40. Preferably, the score line 54 has a depth that extends at least through 50% of the thickness of web 14.

From the foregoing, it may now be readily understood that holder 10 according to the first exemplary embodiment of the present invention may receive and retain objects, such as beverage cans 12, in a manner substantially identical to that shown with respect to the holder shown in the prior art. However, contrary to the structure shown in FIG. 1, holder 10 is constructed so that proper operation destroys the integrity of the loop-shaped structures which retain objects 12. In FIG. 1, when the objects 12 are removed, the loop-shaped retaining structures remain closed so that a portion of the body of an animal may become ensnared therein. Proper use and removal of objects 12 from holder 10 according to the present invention destroys the integrity of these loop-shaped structures by severing peripheral margin 34. Specifically, in use, a person removes an object 12 by grasping the respective pull-tab 44 between his/her thumb and fore finger and by then ripping margin 34 of the respective retaining portion 30 along score line 54, as is shown in FIG. 2. It should be appreciated that this severance of the retaining portion acts both to release the object 12 while simultaneously opening the loop-shaped structure formed by the retaining portion 30. Since pull-tab 44 is formed integrally with web 14, the pull-tab structure remains attached to web 14, and no additional piece of debris results.

Figure 6:
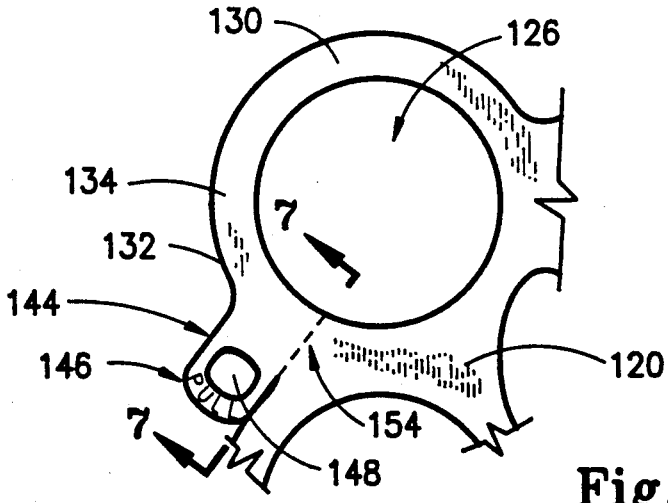
FIG. 6 shows a top plan view of another exemplary embodiment of a retaining portion for the holder of the present invention.

FIG. 6 shows an alternative embodiment of the present invention. In FIG. 6, the pull-tab structure 144 projects radially outwardly from the peripheral edge portion 132 of the retaining portion 130 and is formed integrally with web 119 as a lobe 146 in contrast to the embodiment shown in FIGS. 2–5 where the pull-tab 44 is formed out of margin 34. Naturally, the pull-tab can be formed in a variety of shapes for example an elongated tab, a circular tab or bowl shaped ovals adapted to conform to the thumb, etc.

The retaining portion 130 in FIG. 6 has a score line 154 that similarly projects radially outwardly from the respective opening 126 across the width of the margin 134. The lobe 146 which projects radially outwardly from a respective opening 126 may have a port, such as port 148, sized to receive a human finger whereby the pull-tab structure 144 is readily grasped and operated.

Figure 7:
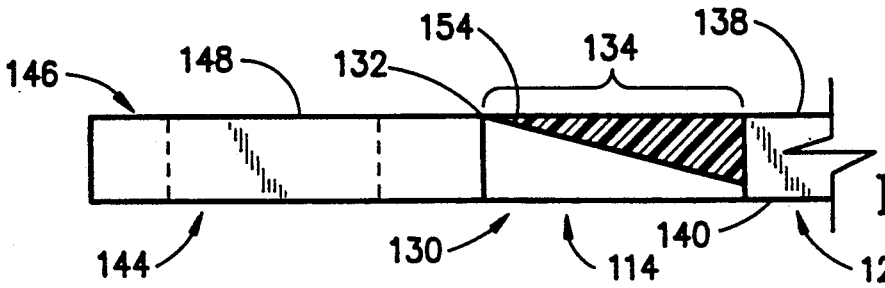
FIG. 7 shows a cross-sectional view taken about line 7—7 of FIG. 6.

The pull-tab structure 144 and the score line 154 is shown in cross-section in FIG. 7. With reference to this FIGURE, web 114 has a thickness between upper surface 138 and lower surface 140. Score line 154 is shown to have a variable depth across the width of the peripheral margin 134 of the respective retaining portion 130. Thus, the score line 154 extends deeper into the thickness of the margin 134 at a location proximate its associated pull-tab 144 and a shallower depth proximate to opening 126. Preferably, score line 154 extends into the thickness until it reaches 90% of the depth, and score line 154 is deeper closer to the peripheral edge 132 of the retaining portion 130. This type of score line has two advantages. First, there is less likelihood that the score line 154 will tear and inadvertently release the object the loop has enclosed; and, second, it facilities the user's ability to easily sever the loop-shaped structure.

Figure 8:
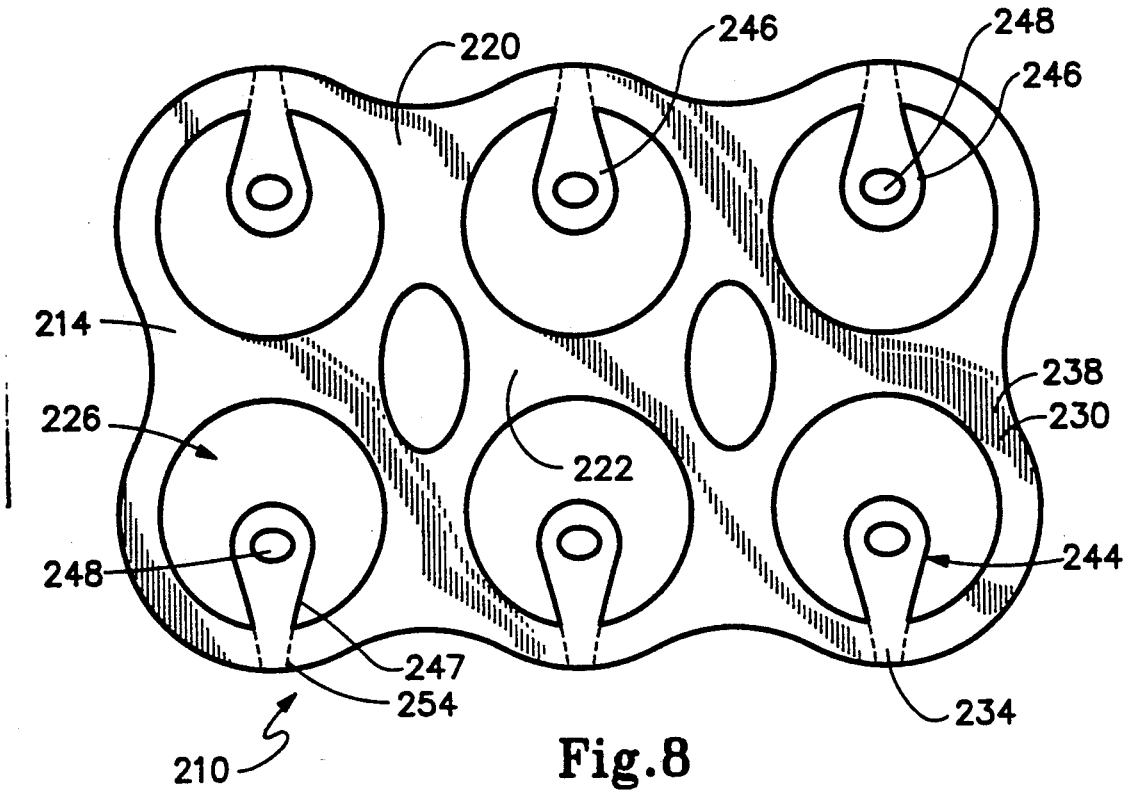
FIG. 8 shows a top plan view of yet another exemplary embodiment of the holder according to the present invention.

Turning to FIG. 8, another exemplary embodiment of the present invention is shown. Again, as previously noted the holder 210 has a web 214 with a central panel portion 222, a retaining portion 230 and pull-tab structure 244. The pull-tab structure 244 in this embodiment is formed as lobes 246, each having a port 248 sized to receive a finger similar to the pull-tab structure 244 shown in FIG. 6. However, in this embodiment the pull-tab structure 244 projects radially inwardly into the opening 226 of the respective retaining portion 230. Pull-tab 244 has a thickness approximately the same as the thickness of the retaining portion 230. The score line 254 which is in association with the pull-tab 244 projects radially outwardly from the respective opening 226 at a location immediately adjacent one edge, such as edge 247, of the pull-tab structures.

Figure 9:
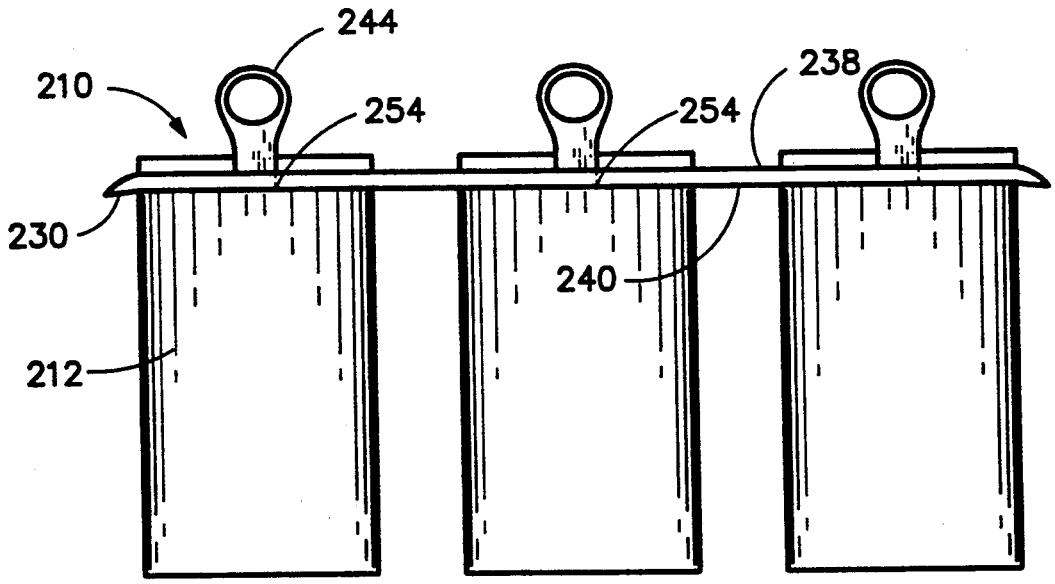
FIG. 9 shows a side view of the holder shown in FIG. 8 and including containers received in their respective opening.

The pull-tab 244 projects from the margin 234 radially inwardly when there is no can in the respective opening 226 so that it is in a first position coplanar with web 214. However, as is depicted in FIG. 9, the pull-tab structure 244 has a second position when an object is received in a respective opening 226. When the object 212 is received in the respective opening 226 the pull-tab 244 is deflected away from the opening 226 and the object 212. Thus, in the second position the pull-tab 244 is projects upwardly relative to the upper surface 238 and oppositely of the lower surface 240 of the retaining portion 230. This second position of the pull-tab 244 locates the pull-tab 244 such that it is readily accessible to the user. The pull-tab 244 when in the second position can be firmly gripped between the user's fingers and thumb and pulled along the score line 254. The material associated with the score line 254 severs and the object 212 is released. The resultant severed loop-structure of the present invention poses substantially less risk to the ecosystem if it is improperly discarded then does the prior art.

Accordingly, the present invention has been described with some degree of particularity directed to the preferred embodiment of the present invention. It should be appreciated, though, that the present invention is defined be the following claims construed in light of the prior art so that modifications or changes may be made to the preferred embodiment of the present invention without departing from the inventive concepts contained herein.

We claim:

1. A holder adapted to releasably retain a plurality of objects each having a common geometric shape and adapted to permit release of each said object individually, comprising:

a central panel portion;

a plurality of retaining portions joined with said central portion, said retaining portions each having an upper surface and a lower surface and a thickness measured between said upper and lower surfaces, each said retaining portion having an opening sized to receive a respective one of said objects and having an outer peripheral edge portion with a peripheral margin of a selected width located between said opening and said peripheral edge portion, each retaining portion thereby defining a loop-shaped structure that acts to retain a respective said object in the opening thereof; and a pull-tab structure corresponding to each of said retaining portions, each said pull-tab structure joined to its respective retaining portion along the margin thereof, each said margin having a score line having a variable depth across the width of said margin and having a selected length and extending at least partially across the width of said margin and proximate to the respective pull-tab whereby the respective pull-tab may be operated both to release the object and sever the loop-shaped structure.

2. A holder in accordance with claim 1 wherein the plurality of retaining portions form at least four openings.

3. A holder in accordance with claim 1 wherein said pull-tab is formed as a lobe.

4. A holder in accordance with claim 1 wherein said lobe has a port sized to receive a human finger whereby said pull-tab structure is readily grasped and operated.

5. A holder in accordance with claim 1 wherein said central panel portion includes a carrying means adapted for allowing manual transport of the plurality of objects as a single unit.

6. A holder in accordance with claim 5 wherein said carrying means is formed by a plurality holes sized and configured to be grasped by a person's hand and fingers.

7. A holder in accordance with claim 1 wherein said pull-tab structure is integrally formed with said retaining portion.

8. A holder in accordance with claim 1 wherein said opening along said central portion is circular and said score line projects tangentially therefrom.

9. A holder in accordance with claim 1 wherein the central portion has a transverse and longitudinal axis which intersect at a mid-point, said retaining portions being symmetrical about both said transverse and longitudinal axes.

10. A holder in accordance with claim 1 wherein each said retaining portion includes an upper surface and a lower surface which defines a thickness of said retaining portion therebetween, said score line having a depth extending into said retaining portion at least 50% of the thickness thereof.

11. A holder in accordance with claim 1 wherein each said score line is deeper at a location proximate its associated said pull-tab.

12. A holder in accordance with claim 1 wherein each said pull-tab projects outwardly of its respective retaining structure.

13. A holder in accordance with claim 1 wherein each said pull-tab projects inwardly into the opening of its respective retaining structure.

14. A holder in accordance with claim 13 wherein each said pull-tab is positioned so that, when one of said objects is received in the respective opening, said pull-tab is deflected away from the opening and said object whereby access to said pull-tab is enhanced.

15. A holder in accordance with claim 1 wherein each said score line projects radially outwardly from its respective opening and each said pull-tab projects radially of its respective opening.

16. In a holder adapted to releasably retain a plurality of cylindrical cans as a packaged unit wherein said holder is formed as a planar web having a peripheral edge and a thickness between an upper surface and a lower surface thereof, said holder having plurality of circular openings formed therethrough to form a plurality of loop shaped structures each operative to receive and retain a respective cylindrical can, the improvement comprising a pull-tab associated with each of the openings and a score line associated with each said pull-tab, each said score line having a variable depth extending through the thickness of said web and extending at least partially across a margin portion of said web between a respective of opening and said peripheral edge and located proximate the associated pull-tab said scoreline having a greater depth proximate the pull-tab than proximate the opening, whereby each said pull-tab may be manually grasped and operated to sever the respective margin both releasing a can received in the respective opening and break open the respective loop-shaped structure.

17. A holder in accordance with claim 16 wherein said pull-tab projects from said margin radially inwardly of its respective opening and having a first position when there is no can in the respective opening and a second position when a can is received in that respective opening.

18. A holder adapted in accordance with claim 1 wherein said pull-tab radially projects upwardly of said upper surface when said pull-tab is in the second position whereby said pull-tab is thereby positioned to be readily accessible to be manually pulled wherein said retaining portion is parted.

* * * * *